United States Patent [19]

Bulloch

[11] 4,161,406

[45] Jul. 17, 1979

[54] SOLUTION AND METHOD FOR PROCESSING HIGH SPEED VIDEO NEWS FILM

[75] Inventor: David K. Bulloch, Hillsdale, N.J.

[73] Assignee: Philip A. Hunt Chemical Corp., Palisades Park, N.J.

[21] Appl. No.: 858,193

[22] Filed: Dec. 7, 1977

[51] Int. Cl.[2] ..... G03C 7/00

[52] U.S. Cl. ..... 96/55; 96/22; 96/59; 96/66 R; 96/66.3

[58] Field of Search ..... 96/22, 59, 66.3, 66 R, 96/55

[56] References Cited

U.S. PATENT DOCUMENTS

| | | | |
|---|---|---|---|
| 3,246,987 | 4/1966 | Hanson et al. | 96/59 |
| 3,592,652 | 7/1971 | Bard | 96/55 |
| 3,617,273 | 11/1971 | Arai et al. | 96/22 |
| 3,617,282 | 11/1971 | Bard et al. | 96/59 |
| 3,883,354 | 5/1975 | Molenda | 96/22 |

OTHER PUBLICATIONS

Photo-Lab-Index, Quaterly Supplement No. 133, pp. 3-266.20 to 3-266.25, Morgan & Morgan, Inc., Hastings-on-Hudson, N.Y., (1972).

*Primary Examiner*—J. Travis Brown
*Attorney, Agent, or Firm*—Kirschstein, Kirschstein, Ottinger & Cobrin

[57] ABSTRACT

A high speed color reversal cine film with latent images recorded thereon is so processed as to color-develop the latent images and concurrently reduce the high contrast at the dark end of the tone scale which is inherent in the prior art development of such film. The new method utilizes in the color developer bath increased amounts (in comparison with prior art color developer baths) of a competing coupler such as citrazinic acid and of a silver halide solvent such as ethylene diamine and reduces the amount of a reversal agent such as t-butylamine borane, and also includes a competing non-coupling developer such as 4-hydroxymethyl-4-methyl-1-phenyl-3-pyrazolidone, or phenidone, or a derivative thereof.

3 Claims, No Drawings

SOLUTION AND METHOD FOR PROCESSING HIGH SPEED VIDEO NEWS FILM

BACKGROUND OF THE INVENTION

1. Field of the Invention

A bath and process for reversal color development of high speed color cine film to produce color positives having reduced contrast at the dark end of the tone scale.

2. Description of the Prior Art

There currently are on the market films that are used for motion picture cameras and particularly for the taking of color motion pictures. One such film is a high speed color reversal cine film. Such a film, after processing, will yield high contrast images which are intended to be used for direct projection. The usual final use of such a film is to make color cine prints to be released for general public consumption, as to theaters or to television stations or for direct viewing through a telecine chain (air prints). When the prints released are duplicates of the original, the film used for the duplicates (prints) is a low contrast color reversal cine film. Even so, the high contrast of the original film is further increased by the duplication step.

A present day typical high speed color reversal cine film is an Eastman high speed VNF (Video News Film) 7250 (a speed of 400 tungsten and 250 daylight with an 85 conversion filter). Other typical high speed color cine VNF films are Eastman 5240 and 7240 (a speed of 125 tungsten and 80 daylight with an 85 conversion filter). These films are of relatively high contrast, designed for direct projection without duplication. A typical present day original reversal film is Eastman Kodak's Ektachrome commercial film 7252(a speed of 25 tungsten and 16 daylight with an 85 conversion filter). This is a low contrast original film not meant for direct projection but designed as a printing film, i.e., for duplication. The major disadvantage of this film is its unusually low camera speed.

The current practice for many filmic situations such as news gathering, cinema verité, documentaries, and location shots where electric power for supplemental lighting is unavailable, requires the use of a much higher camera speed than that provided by slow speed low contrast film and hence it has become mandatory to use the high speed VNF film for television news gathering, documentary filming, industrial filming and the like where the lighting is poor and/or the filmic situation is relatively uncontrollable. Where high speed cine film of the color reversal type is used for television news (in which time is of the essence) or where the film is to be later duplicated at a film processing laboratory, the problem of high contrast in the original creates considerable difficulties. Frequently the contrast, either that of the original or that of the duplicate produces unacceptable pictorial results. The problem is that the mid-scale and dark areas of the D log E curve are too "contrasty," resulting in an inability to distinguish between different shades of darkness. For example, if a dark skinned person is located in a heavily shadowed area, their face and background will blend and distinguishing features will be lost. The television industry refers to the problem as one of "dark tone compression," meaning that a given dark object is indistinguishable from an adjacent dark object. This is a direct result of a high contrast image effected by the harsh lighting conditions encountered in most news cine stories and the inability of the television broadcasting industry, with its presently available equipment, to reproduce for viewing the long tonal scale of a direct projection film.

In order to overcome this problem, the current practice of the television and certain segments of the movie industry with regard to film destined to be developed for documentaries, features or for news stories, where it is known that dark tone compression will be encountered, is to post flash the exposed but undeveloped images in which the aforementioned problem otherwise would arise. The pictorial effect of post flashing is to reduce image contrast. When practiced, it actinically reduces the high contrast inherent in a high speed color reversal camera film. However, post flashing is a very difficult procedure. It must be performed on a carefully controlled motion picture printer by a highly trained technician, and preferably is done to an exposed image only after the effects of post flashing have been tested on a raw stock of a similar origin, for example, the same lot number of emulsion.

The difficulties associated with post flashing are many. It can and frequently does result in a scratching of the emulsion. The flashed image may be uneven due to mechanical problems. There has been a lack of repeatability on a day-to-day basis. The trade has no set standards for post flashing; the judgment of the operator must be relied on totally. Post flashing preferably is not used for television news because in addition to all of its other drawbacks, the time delay in sending a film—an undeveloped film—to a motion picture laboratory for post flashing and having it returned is intolerable. Television news is cursed with the need for immediacy. The television news media does not want to be subjected to the time delay necessary for a motion picture laboratory to treat film. It does not wish to subject itself to the uncontrollable vagaries of a third party film processor. It wishes rigorously to control the time needed for processing by having the processing performed by its own personnel on its own premises and these personnel are not trained sufficiently to do post flashing. Furthermore, post flashing adds an additional cost to the processing of VNF and if performed by the television studio technicians would necessitate the addition of considerable extra equipment.

SUMMARY OF THE INVENTION

1. Purpose of the Invention

It is an object of the invention to provide a solution and process for development of a high speed color reversal cine film which overcomes all of the foregoing drawbacks.

It is another object of the invention to provide a bath and process of the character described which limits the tonal range of the dark end of the tonal scale of a high contrast color reversal cine film.

Another object of the invention is to provide a bath and process of the character described which reduce the contrast normally inherent in a developed high speed color reversal cine film.

It is another object of the invention to provide a bath and process of the character described which can be employed on existing processing equipment so that an operator does not have to learn any new techniques or become accustomed to new technology or new equipment.

It is another object of the invention to provide a bath and process of the character described which enable an operator already skilled in processing high speed color reversal cine film to reduce the contrast of the film.

Other objects of the invention in part will be obvious and in part will be pointed out hereinafter.

2. Brief Description of the Invention

In accordance with the present invention, except for the color developing solution, conventional processing equipment, conventional processing steps and conventional treating solutions are used to develop a high speed color reversal image exposed cine film. The single exception is, as noted, the color developing bath. The color developing bath used in connection with the instant invention is the same as a conventional color developer bath for film of the character described with a few most important significant changes. These changes are:

(1) An increase in the amount of a competing coupler such as citrazinic acid, (2) An increase in the amount of a silver halide solvent such as ethylene diamine, (3) A decrease in the amount of a reversal agent such as t-butylamine borane, (4) The inclusion of an additional ingredient which is a competing non-coupling (black-and-white) developer such as 4-hydroxymethyl-4-methyl-1-phenyl-3-pyrazolidone, or phenidone or a derivative thereof.

The amounts of the four above named ingredients must be closely controlled within limited ranges and the dye booster, benzyl alcohol, must be eliminated to achieve the desired result which is, in effect, a reduction of overall contrast.

(5) Elimination of the dye booster, benzyl alcohol.

DESCRIPTION OF THE PREFERRED EMBODIMENT OF THE INVENTION

The present invention is concerned with the processing of an image exposed high speed color reversal cine film. A typical such film is Eastman Kodak's high speed VNF 5240/7240 or Eastman Kodak's high speed VNF 7250. Usually the film will have been exposed under conditions of uncontrolled lighting, that is to say natural lighting, i.e., day-to-day lighting, which happens to exist at the place and time where an event is being filmed. The film must be used to capture the event under all reasonable variations of lighting; no supplemental lighting will be supplied because ordinarily a camera lighting crew may not be available to supply additional light to fill in the dark spots or such task may be impractical. Therefore, the film that is being used must be of high speed. Heretofore, a film such as this has been developed by established procedures in conventional machinery and with conventional chemicals. The resulting developed film inherently is of high contrast.

The conventional method of processing such a film is by the use of Eastman Kodak's VNF-1 process which is well-known in the industry. This process is a standard cine color reversal process consisting of the following steps:

| Steps | Temperature in °C. | Mins. and secs. |
|---|---|---|
| First developer | 37.8 ± 0.3 | 3'10" |
| First stop | 35 ± 3 | 30" |
| Wash | 38 ± 1 | 1'00" |
| Color developer | 43.3 ± 0.6 | 3'35" |
| Second stop | 35 ± 3 | 30" |
| Wash | 38 ± 1 | 1'00" |
| Bleach | 35 ± 3 | 1'30" |

-continued

| Steps | Temperature in °C. | Mins. and secs. |
|---|---|---|
| Fix | 35 ± 3 | 1'30" |
| Wash | 38 ± 1 | 1'00" |
| Stabilizer | 35 ± 3 | 30" |

Information on said process is described in a 1975 publication of the Eastman Kodak Company entitled "Manual For Process VNF-1 Using Kodak Packaged Chemicals."

The above time, temperatures and steps are delineated at page number 402 of the manual. The chemistry of said steps is described in 1974 and 1975 publications of the Eastman Kodak Company entitled "Manual For Processing of Kodak and Eastman Ektachrome Films Using Processed ME-4."

The ME-4 process is similar to the VNF-1 process except that the prehardener and the neutralizer of the ME-4 process is not employed in the VNF-1 process and except that the fixer for the VNF-1 process must be an ammonium thiosulfate type whereas in the ME-4 process for use of ammonium thiosulfate is optional.

The equipment used for carrying out the VNF-1 process is a continuous type of process which is one including a series of tanks through which a long strip of image-exposed films is passed with the assistance of rollers. The long strip of films is made by splicing together individual rolls of exposed cine films so that the long strip can be passed through the machine without stopping. The portions of the long strip which previously constituted the individual rolls are subjected to identical processing temperatures and chemicals. The films move through the sequential processing steps without halt, being guided by mechanically driven spools that are mounted on racks which fit into tanks containing the processing solutions for the sundry processings steps. As is well known, the film is threaded on the spools in a series of continuous loops.

Heretofore, this equipment was located on the premises of television studios and was operated by the personnel of the television studios. Of course, if the film were to be post flashed, the above described processing had to be carried on by third parties who would do both the post flashing and the development, as well as the series of steps associated with the development. As mentioned previously, this prevented television studios from processing the film and caused a consequent increase in costs and a consequent delay in preparing a film for broadcasting. Also a certain expense is involved and some changes have to be made in conventional development to accommodate the previous equipment for the inclusion of the post flashing step.

The present invention eliminates the post flashing step and produces from a high speed, high contrast reversal cine color film a positive color low contrast image. It thus meets the needs of the television industry as well as of those industries which require duplication of original cine films with an expanded tonal scale at the dark end.

With reference to the conventional VNF-1 process, the presend invention uses all of the steps thereof except that a different color developer is substituted and no flashing is needed. In order precisely to define the novelty of the present invention, the color developer of the present invention should be compared with the color developer used in the VNF-1 process.

The prior art VNF-1 color developer ingredients are set forth in formula I which follows:

FORMULA I

| Ingredients | Quantity per liter |
|---|---|
| Water | 800 ml. |
| Sodium tetraphosphate (calcium sequestering agent) | 3.0 g. |
| Benzyl alcohol (dye booster) | 4.5 ml. |
| Sodium sulfite [anhydrous] (anti-oxidant) | 7.5 g. |
| Trisodium phosphate . 12 $H_2O$ (buffer) | 36.0 g. |
| Sodium bromide (restrainer) | 0.9 g. |
| Potassium iodide (restrainer) | 0.09 g. |
| Sodium hydroxide (alkalizing agent) | 3.25 g. |
| Citrazinic acid (competing coupler) | 1.5 g. |
| The sesquisulfate monohydrate of 4-amino, 3-methyl, N-ethyl, N-beta-methanesulfonamido ethyl aniline (color developing agent), known as CD-3 | 11.0 |
| | 11.0 |
| Ethylene diamine (silver halide solvent) | 3.0 g. |
| t-butylamine borane (reversal agent) | 0.06 g. |
| Water to make | 1 liter |
| pH at 27° C. | 11.65 ± 0.1 |

It is well known that it is extremely difficult to reformulate a color developer in a manner such that the contrasts, the speeds and the maximum densities of the blue-, the green- and the red-sensitive layers of a given silver halide color film are changed equally in such a fashion that the three gradients of the D log E curve are maintained and the overall color balance likewise is maintained. Pursuant to the present invention, a new low contrast formulation has been discovered which accomplishes both of the foregoing desiderata on Eastman Kodak VNF 7240, 7250 and 5240 emulsions. The new formulation represents a considerable change from the conventional color developer formulation set forth in Formula I.

A typical low contrast formula according to the present invention is given in Formula II below wherein, as will be seen, the following characteristic differences are present:

(1) the amount of the competing coupler—citrazinic acid—is increased from its previous 1.5 g./l. level to the considerably higher range of 3 to 5 g./l.; instead of citrazinic acid another competing coupler can be used, namely 1-amino-8-naphthol-3, 6-disulfonic acid in a range of 0.3 to 0.8 g./l.;

(2) the amount of the silver halide solvent—ethylene diamine—is increased from its previous 3.0 g./l. level to the considerably high range of 6 to 12 g./l.;

(3) the amount of the reversal agent—t-butylamine borane—is decreased from its previous 0.07 g./l. level to the considerably lower range of 0 to 0.015 g./l. level;

(4) the dye booster—benzyl alcohol—is omitted in order to reduce dye density (the elimination of benzyl alcohol does not cause a uniform reduction in dye density in all of the three layers of the color emulsion and hence introduces an undesirable color balance and contrast which, however is rebalanced by formula optimization as will be apparent from Formula II;

(5) a competing non-coupling (black-and-white) developer—4-hydroxymethyl-4-methyl-1-phenyl-3-pyrazolidone, or phenidone, or a derivative thereof—is added, the amount thereof being from 0.05 to 0.3 g./l.

Upper scale contrast control was found in part to be a function of the citrazinic acid concentration and, surprisingly, the much higher than normal level of ethylene diamine and the much lower than normal level of the t-butylamine borane (whose normal use is as a reversal agent, but here functions as a control of the upper scale contrast). The inclusion of the competing non-coupling developer corrects the toe gradient.

EXAMPLE II

| Ingredient | Quantity per Liter |
|---|---|
| Water | 800 ml. |
| Sodium tetraphosphate (calcium sequestering agent) | 4.0 g. |
| Sodium sulfite [anhydrous] (anti-oxidant) | 6.8 g. |
| Potassium phosphate-tribasic (buffer) | 28.0 g. |
| Sodium bromide (restrainer) | 0.9 g. |
| Potassium iodide (restrainer) | 0.07 g. |
| Potassium hydroxide (alkalizing agent) | 10.7 g. |
| Citrazinic acid (competing coupler) | 3.5 g. |
| Methyl alcoholate of the orthophosphate salt of 4-amino, 3-methyl, N-ethyl, N-beta-methanesulfonamidoethyl aniline (color developing agent) (U.S.L.P. No. 3,875,227) | 9.1 g. |
| Ethylene diamine (silver halide solvent) | 9.0 g. |
| t-butylamine borane (reversal agent and contrast control agent) | 0.017 g. |
| 4-hydroxymethyl-4-methyl-1-phenyl-3-pyrazolidone (competing non-coupling developer) | 0.11 g. |
| Water to make | 1000 ml. |
| pH at 27° C. | 11.71 ± 0.05 |

In accordance with the present invention the only novel criteria in the color developing bath of the instant invention are: the competing coupler in the range indicated, the silver halide solvent in the range indicated, the reversal agent in the range indicated, the elimination of benzyl alcohol and the competing non-coupling developer in the range indicated.

With respect to the remaining ingredients of the new color developer bath the particular amounts thereof are within conventional prior art ranges and are not critical to the present invention; generally speaking, a variation of up to ±20 percent from the amounts listed in Example II is permissible. However varying any of the given ingredients will change the color balance and contrast so that a change in any one ingredient usually will require a corresponding change in one or more other ingredients to achieve the desired color balance and contrast. The actual color balance and contrast is a matter of subjective opinion and the optimization of the ratios of the ingredients conventionally is left to the visual judgment of an expert which conforms to that of an average member of the public.

It will be appreciated by persons skilled in this field that various substitutions can be made for the non-critical ingredients. For instance, other conventional calcium sequestering agents can be substituted for the sodium tetraphosphate, care being exerted not to select sequestering agents which will affect the functions of any other ingredients. The buffer may be trisodium phosphate instead of tribasic potassium phosphate in which case a slightly different amount will be used. The alkalizing agent may be sodium hydroxide instead of potassium hydroxide. The color developing agent may be that of the first example in which case 10 g./l. will be used. The competing non-coupling developer may be phenidone in which case 0.1 g./l. will be used, or a phenidone derivative may be used.

The desired $D_{max}$ is at least 2.0 and the middle tone contrast should be in the range of 1.0 to 1.3.

The color developer of the present invention is used in precisely the same manner as a standard color developer for the Eastman Kodak VNF-1. It can be used to replace the standard color developer for Eastman Kodak VNF-1.

The low contrast images produced with the use of the new color developer meets the needs of the television news industry and those requiring low contrast original cine films for duplication.

The new color cine developer has the advantage of simplicity of use, requiring no additional film handling or tedious print testing. It simply replaces the prior art color developer used in the VNF-1 process with a new formulation that yields the desired result. No post flashing is needed. No modification of machinery is required nor is any change in times or temperatures of processing required.

It thus will be seen that there is provided a composition and a method of using the same which achieve the several objects of the invention and which are adapted to meet the conditions of practical use.

As various possible embodiments might be made of the above invention, and as various changes might be made in the embodiment above set forth, it is to be understood that all matter herein described is to be interpreted as illustrative and not in a limiting sense.

Having thus described the invention, there is claimed as new and desired to be secured by Letters Patent:

1. A bath for color development of imagewise exposed VNF high speed color reversal cine film the emulsion of which contains latent silver halide images and which incorporates color couplers, said film having been black and white developed and having thereafter been stopped, the color developing bath concurrently reducing contrast without flashing, which color developer bath includes water, a calcium sequestering agent, an anti-oxidant, a buffer, a restrainer, an alkalizing agent and a color developing agent, that improvement comprising:

(A) the absence of benzyl alcohol from said color developer bath, (B) the inclusion in said color developer bath of a competing coupler selected from the group consisting of 3–5 g./l. of citrazinic acid and 0.3–0.8 g./l. of 1-amino-8-naphthol-3, 6-disulfonic acid, 6–12 g./l. of the silver halide solvent ethylene diamine, 0–0.015 g./l. of the reversal and contrast control agent t-butylamine borane and 0.05–0.3 g./l. of a competing non-coupling developer selected from the group consisting of 4-hydroxymethyl-4-methyl-1-phenyl-3-pyrazolidone, phenidone and phenidone derivatives, (C) the pH of the color developer bath being about 11.7, (D) and which film after color development is stopped, bleached and fixed.

2. A bath as set forth in claim 1 wherein: the competing coupler is 3.5 g./l. of citrazinic acid, and there is 9 g./l. ethylene diamine, 0.017 g./l. t-butylamine borane, and 0.11 g./l. 4-hydroxymethyl-4-methyl-1-phenyl-3-pyrazolidone.

3. In a method of color developing of VNF high speed color reversal cine film the emulsion of which contains latent silver halide images and which incorporates color couplers, said film having been black and white developed and having thereafter been stopped, the color developing bath concurrently reducing contrast without flashing, that improvement comprising treating said film in a bath which includes water, a calcium sequestering agent, an anti-oxidant, a buffer, a restrainer, an alkalizing agent and a color developing agent characterized in that said color developing bath has no benzyl alcohol and includes a competing coupler from the group consisting of 3–5 g/l of citrazinic and 0.3–0.8 g/l of 1-amino-8-naphthol-3, 6-disulfonic acid, 6–12 g/l of the silver halide solvent ethylene diamine, 0–0.015 g/l of the reversal and contrast control agent t-butylamine borane and 0.05–0.3 g/l of a competing non-coupling developer selected from the group consisting of 4-hydroxymethyl-4-methyl-1-phenyl-3-pyrazolidone, phenidone and phenidone derivatives, the pH of said color developing bath being about 11.7, and the film after color development being stopped, bleached and fixed.

* * * * *